United States Patent [19]

Birchard

[11] Patent Number: 4,765,225

[45] Date of Patent: Aug. 23, 1988

[54] DIGITALLY CONTROLLED AIR-OVER-HYDRAULIC ACTUATOR AND METHOD

[76] Inventor: William G. Birchard, 9710 Golf Links Rd., Tucson, Ariz. 85730

[21] Appl. No.: 899,505

[22] Filed: Aug. 22, 1986

[51] Int. Cl.[4] ..... F15B 13/16; F15B 15/22

[52] U.S. Cl. ..... 91/362; 91/429; 91/435; 91/459; 92/9; 251/129.1

[58] Field of Search ..... 91/429, 435, 459, 361, 91/362, 275; 92/8, 9, 11, 12, 120; 137/624.13; 251/129.1, 325

[56] References Cited

U.S. PATENT DOCUMENTS

| | | | |
|---|---|---|---|
| 2,101,076 | 7/1937 | Laboureur et al. | 137/624.13 X |
| 2,775,015 | 12/1956 | Erb | 25/16 |
| 2,821,172 | 1/1958 | Randall | 121/40 |
| 2,891,514 | 6/1959 | Moeller | 121/40 |
| 3,176,801 | 4/1965 | Huff | 188/97 |
| 3,463,036 | 8/1969 | O'Connor | 77/32.3 |
| 3,476,266 | 11/1969 | Devol | 214/1 |
| 3,698,826 | 10/1972 | Henderson | 408/17 |
| 3,850,078 | 11/1974 | Polizzi | 91/38 |
| 3,894,477 | 7/1975 | Tomikawa | 91/355 |
| 3,929,057 | 12/1975 | Kondo | 92/9 |
| 4,528,894 | 7/1985 | Crosby | 92/12 |

FOREIGN PATENT DOCUMENTS

| | | | |
|---|---|---|---|
| 403689 | 7/1909 | France | 251/129.1 |
| 336258 | 10/1930 | United Kingdom | 137/624.13 |

OTHER PUBLICATIONS

"Air-Over-Oil Applications", Chapter 12, pp. 223–232.

*Primary Examiner*—Robert E. Garrett
*Assistant Examiner*—Mark A. Williamson
*Attorney, Agent, or Firm*—Cahill, Sutton & Thomas

[57] ABSTRACT

A digitally controlled air-over-hydraulic actuator includes a pneumatic cylinder and a hydraulic cylinder each having a separate piston and a common connecting rod. The pneumatic piston applies force to the connecting rod urging movement of the hydraulic piston. Bleeding of oil from one side of the hydraulic piston to the other is controlled by means of digital pulses applied to a digital valve that allows oil on either side of the hydraulic piston to flow to the other. The digital valve includes a moving piston having an oil passage that is momentarily aligned with ports to opposite sides of the hydraulic cylinder. A control system senses the differential pressure between opposite sides of the pneumatic piston to produce pulses that accelerate the digital valve piston past the ports, precisely controlling forced movement of the hydraulic piston.

29 Claims, 4 Drawing Sheets

FIG. 1
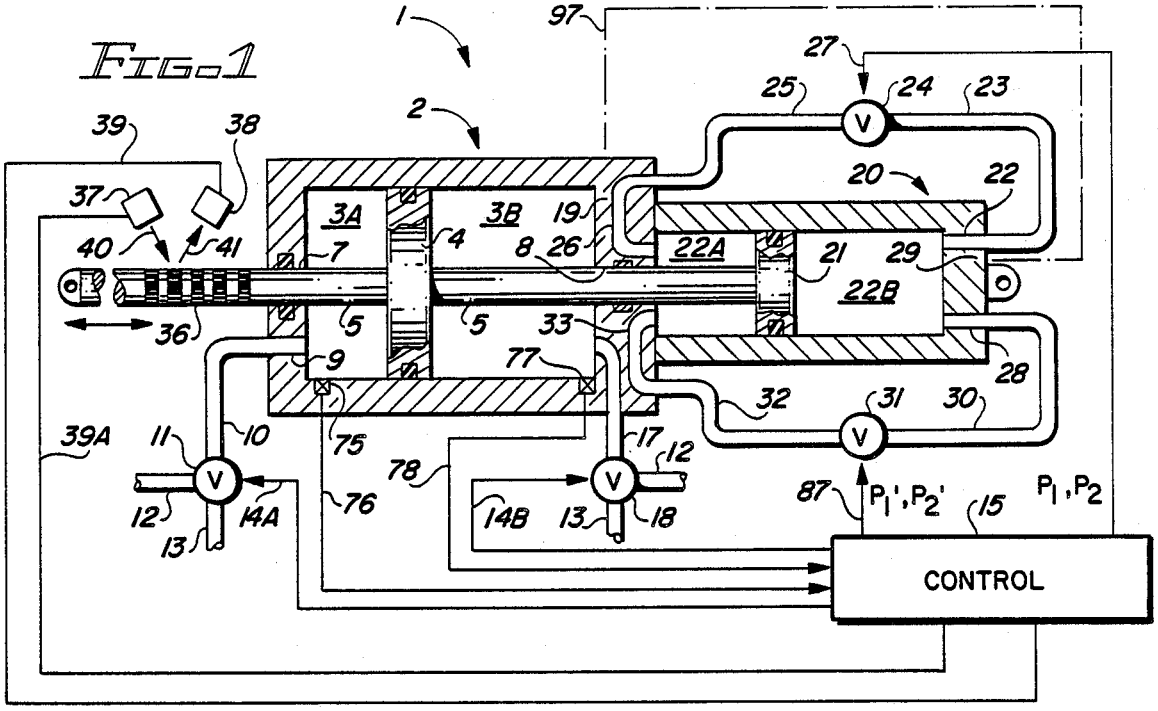
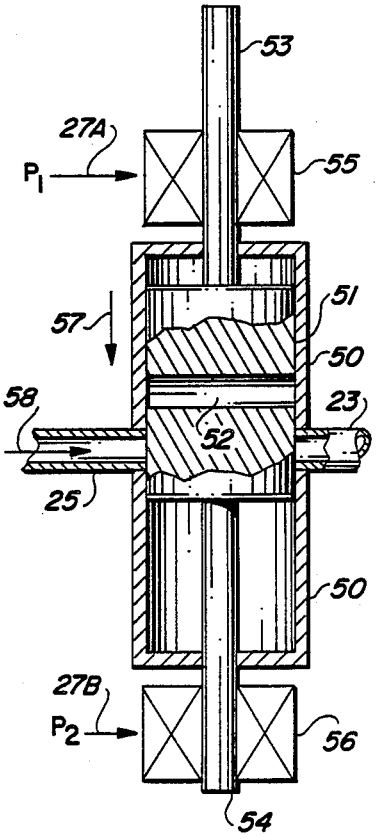
FIG. 2A
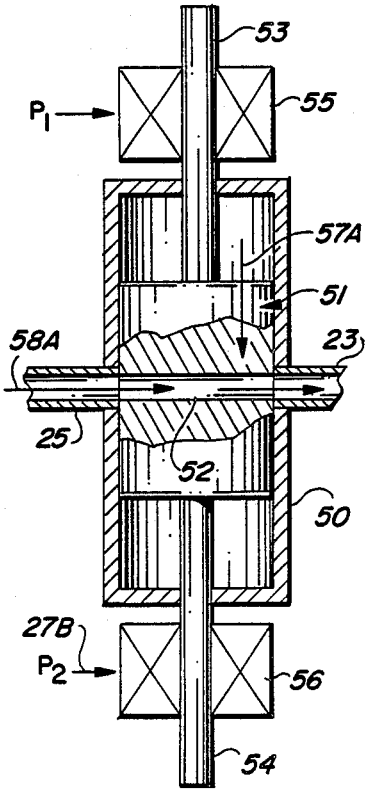
FIG. 2B
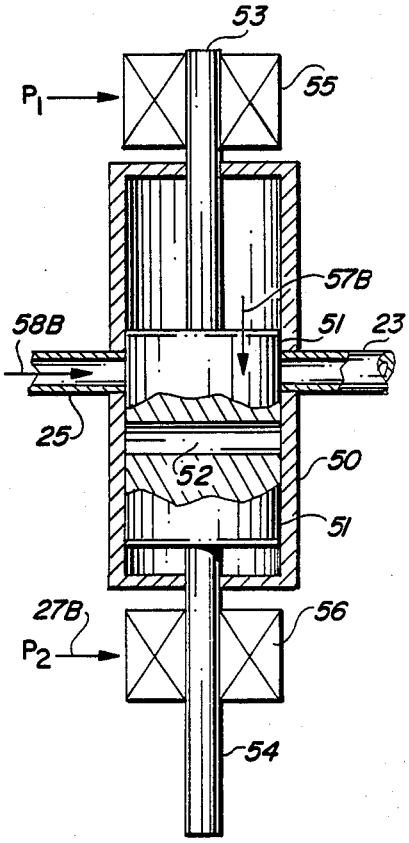
FIG. 2C

FIG. 3
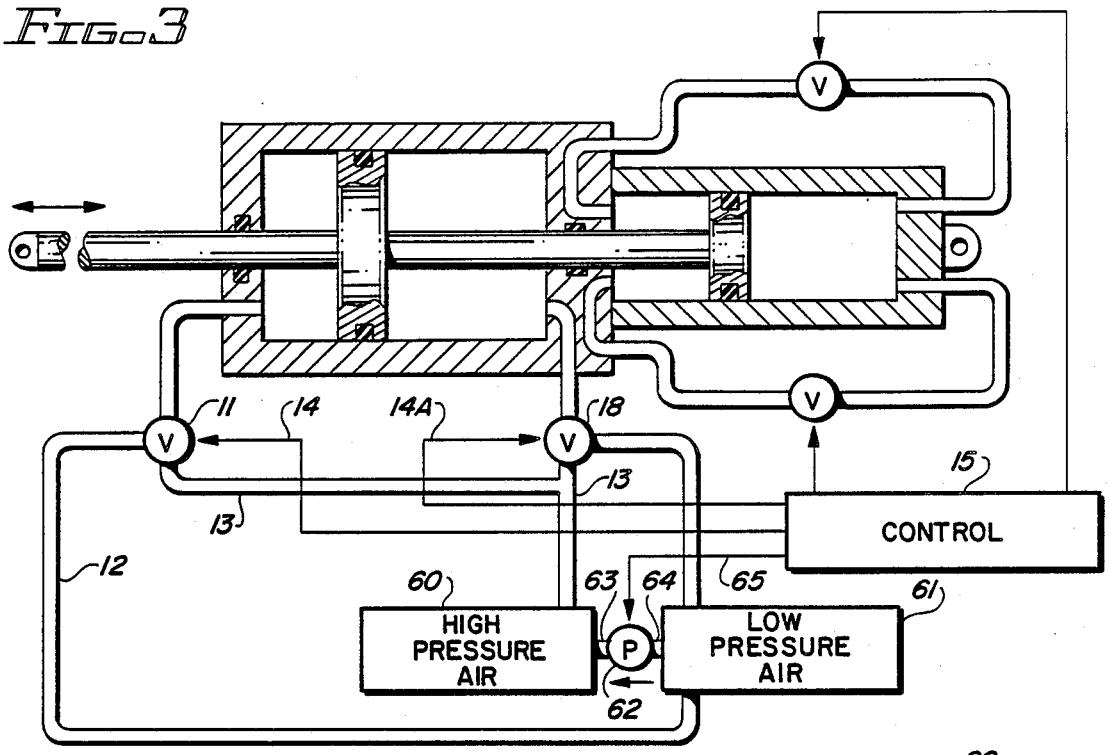
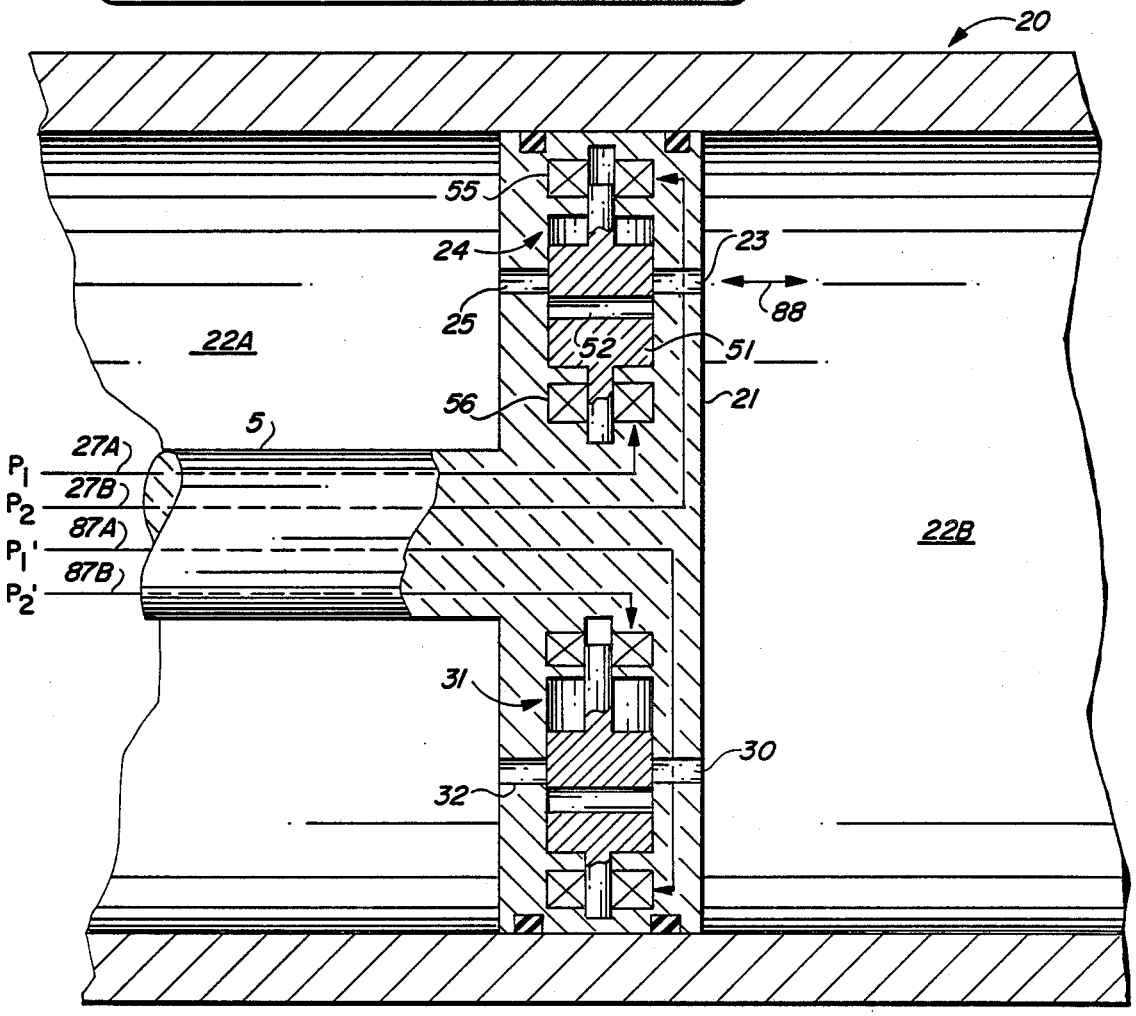
FIG. 4

DIGITALLY CONTROLLED AIR-OVER-HYDRAULIC ACTUATOR AND METHOD

BACKGROUND OF THE INVENTION

The invention relates to actuators useful in robotic applications, and more particularly to actuators capable of providing very large forces, for example, 500 pounds, to control movement of a driven member with a very high degree of precision, for example, with 1 mil precision. The invention more particularly relates to improvements in air-over-hydraulic systems and digital control valves therefor, and to improved methods and apparatus for energizing the pneumatic cylinders.

There are numerous industrial and scientific applications for devices capable of applying a very large force, for example, a several hundred pound force, to a driven member in such a manner as to produce very precise control of the position of the driven member, for example, to within one-thousandth of an inch (i.e., 1 mil). At the present state of the art, pneumatic and/or hydraulic systems, especially inexpensive ones, are incapable of accomplishing this objective. Ordinarily, mechanical systems utilizing gears, jackscrews, screw gears and the like must be utilized when such large forces are to be applied with such high precision to a driven member. Various so-called air-over-hydraulic or air-over-oil systems are well-known, wherein an "active" pneumatic cylinder is utilized to apply a large force to a driven member, and a "passive" hydraulic cylinder is utilized to control the movement of the driven member. Typically, an electronically actuated valve is utilized to allow oil in the hydraulic cylinder to bleed in a controlled manner from one side of the piston of the hydraulic cylinder to the other and thereby limit and/or control the movement of the driven member to which the force is being applied by the pneumatic cylinder. The state of the art is believed to be accurately represented by U.S. Pat. Nos. 4,528,894 (Crosby), 3,176,801 (Huff), and 2,775,015 (Erb). However, none of the air-over-hydraulic systems disclosed in these references have the capability of controlling movement of a member driven by a force as large as 500 pounds with locational precision as nearly as accurate as 1 mil.

There are various applications for actuators capable of applying such large forces to a driven member with 1 mil locational precision, wherein leakage of air vented from pneumatic cylinders is unacceptable. There also are applications wherein utilization of an external bulky source of compressed air to energize a hydraulic cylinder is unacceptable.

There are yet other applications wherein there is a need to provide a minute, precise "forced adjustment" of an already-positioned driven member.

It would be desirable to provide a low cost actuator that is light in weight, and is only about 15 inches by 4 inches by 4 inches in size, yet is capable of providing a controlled force as high as about 500 pounds with precision of at least approximately 1 mil.

Although the prior art discloses a variety of basic mechanical pneumatic and hydraulic elements, no suitably accurate digital valve and technique for combining it with an air-over-hydraulic system has been provided that is capable of achieving locational positioning of a driven member to which forces as high as hundreds of pounds are applied with 1 mil accuracy.

SUMMARY OF THE INVENTION

Accordingly, it is an object of the invention to provide a small, light actuator capable of providing a force as high as several hundred pounds on a driven member and controlling the position of the driven member to an accuracy of within about 1 mil.

It is another object of the invention to provide an actuator capable of providing one mil precision in location of a driven element having a force applied thereto as high as several hundred pounds without use of a feedback control system.

It is another object of the invention to provide an actuator system capable of producing large forces on a driven member and controlling positioning of the driven member with very high accuracy, without connection to an external pneumatic source.

It is another object of the invention to provide an actuator system capable of providing very large forces on a driven member, accurately positioning the driven member with a very high degree of precision, and providing an accurate controlled "forced adjustment" of the position of the driven member.

Briefly described, and in accordance with one embodiment thereof the invention provides an actuator including a cylinder having a piston and a connecting rod or driven member that is connected in direct communication with a "passive" position control mechanism wherein movement of the driven member, and hence movement of the piston of the cylinder, is controlled by controlling the number of digital pulses applied to the passive position control mechanism. In one described embodiment of the invention, the cylinder is a pneumatic cylinder and the passive position control mechanism includes a hydraulic cylinder, wherein movement of a piston of the hydraulic cylinder, and hence movement of the piston of the pneumatic cylinder, is controlled by controlling the number of digital pulses applied to a digital valve to provide very precise pulsed bleeding of oil from one side of the hydraulic piston to the other. In that described embodiment of the invention, the digital valve includes a moving piston having a transverse fluid passage that is momentarily aligned with oil inlet and oil outlet ports connected in communication with opposite sides of the hydraulic piston as the moving piston is accelerated by one of a pair of solenoids each of which can cause the piston to accelerate from a first "rest position" past the oil inlet and outlet ports of the valve to a second rest position to provide one precisely controlled increment of movement of the hydraulic piston. A control pulse applied to the second solenoid then accelerates the piston from the second rest position to the first rest position, producing a second equally sized increment of controlled movement of the hydraulic piston. Controlled positioning of the hydraulic piston, and hence of the pneumatic piston and the driven member, can be controlled by the simple expedient of electronic pulse counting. An electronic control system senses the pressure differential between the opposite faces of the pneumatic piston, and produces a corresponding control signal to control the velocity of the piston of the digital valve and thereby control the amount of incremental movement of the hydraulic piston in response to each control pulse.

Alternately, the moving piston of the digital valve is precisely accelerated past the oil inlet port and oil outlet port by controlled pneumatic pressure or hydraulic pressure, instead of the first and second solenoids.

In certain described embodiments of the invention, two such digital valves are provided in fluid communication with opposite ends of the hydraulic cylinders, one of the digital valves having a much smaller fluid passage in its movable piston to provide a finer adjustment of the hydraulic piston position. The other digital valve has a larger fluid passage in its movable piston to provide a coarser adjustment of the position of the hydraulic piston.

In one described embodiment of the invention, the digital valve is formed within the walls of the hydraulic cylinder In another embodiment, the digital valve is formed within the hydraulic piston. In another embodiment of the invention, a small piston auxiliary cylinder is connected in parallel with the main hydraulic cylinder. The small area piston of the auxiliary hydraulic cylinder is moved with a relatively small force to provide a mechanical advantage in producing a forced adjustment of the position of the large area piston of the main hydraulic cylinder.

In another embodiment of the invention, the hydraulic cylinder is formed within the pneumatic cylinder, the driven member connected to the pneumatic piston being hollow and having therein an axial rod rigidly connected to an outer end portion of the driven member and to the hydraulic piston, which moves within a cylinder formed concentrically with the pneumatic cylinder and having a bore extending through the pneumatic piston, so the pneumatic piston and driven member slide over the outer surface of the hydraulic cylinder wall while the hydraulic piston moves within the bore of the hydraulic cylinder wall.

In yet another embodiment of the invention, a pneumatic cylinder includes a rotary vane piston attached to an axle or shaft passing through the pneumatic cylinder A rigid radial baffle or stop is provided in the pneumatic cylinder. Pressure is applied and/or vented through control valves on opposite sides of the radial baffle, causing a pressure differential across the rotary vane piston, causing it to rotate within the pneumatic cylinder. Rotation of the vane rotates the shaft, which passes into a hydraulic cylinder having a rotary vane piston therein and a similar radial baffle. Hydraulic fluid is vented from one side of the radial baffle of the hydraulic cylinder to the other by digitally controlled valve to allow precise incremental movements of the vane, and hence to allow precise rotary movement of the shaft connected between the two cylinders.

In another embodiment of the invention, a closed loop air system is provided for venting the pneumatic cylinder into a low pressure tank, the contents of which are pumped by a pump into a high pressure tank which feeds high pressure air through a pair of control valves into a selected chamber of the pneumatic cylinder.

In another embodiment of the invention, pressurization of either side of the pneumatic piston is accomplished by controlled detonation of explosive charges positioned on one side or both sides of the pneumatic piston in the pneumatic cylinder. A controlled force then is applied to the pneumatic piston by controlled venting of one side of the pneumatic cylinder.

In another embodiment of the invention, the explosive charges are controllably injected into either side of the pneumatic piston in the pneumatic cylinder, and a controlled ignitor is provided to ignite the explosive charges after they are injected. The injected charges can include mixtures of oxygen and butane or propane.

BRIEF DESCRIPTION OF THE DRAWINGS

FIG. 1 is a section view diagram illustrating the air-over-hydraulic actuator system of the present invention.

FIGS. 2A–2C are section view diagrams illustrating the operation of the digital valves in FIG. 1.

FIG. 3 is a diagram illustrating a closed loop pneumatic system for pressurizing and venting the pneumatic cylinder in the system of FIG. 1.

FIG. 4 is a diagram illustrating a pair of digital valve built into the hydraulic cylinder of the system of FIG. 1.

DESCRIPTION OF THE INVENTION

Figure 5:
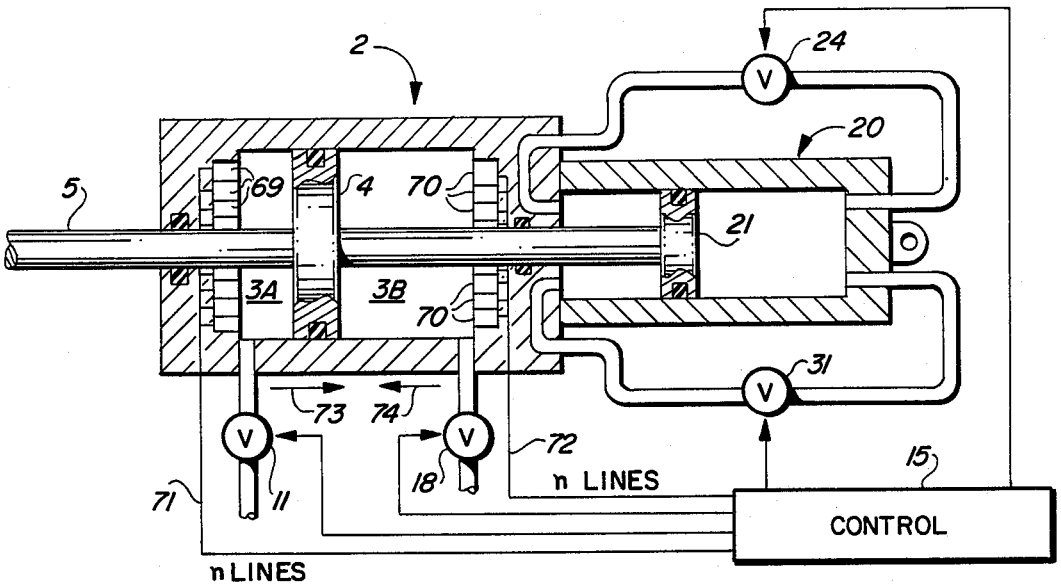
FIG. 5 is a diagram illustrating apparatus for detonating explosive charges in the pneumatic cylinder of the invention to energize it and apply force to the driven member controlled by a hydraulic cylinder.

Referring now to FIG. 1, air-over hydraulic actuator 1 includes a pneumatic cylinder 2 having a piston 4 therein. The interior volume of pneumatic cylinder 2 includes volume 3A on the left-hand side of pneumatic piston 4 and volume 3B on the right-hand side thereof. A connecting rod or driven member 5 is rigidly attached to pneumatic piston 4 and extends through leak-proof seal in opening 7 in the left wall of pneumatic cylinder 2 and through a leak-proof seal in opening 8 through the right-hand wall 19 bounding volume 3B. The left-hand end of rod 5 is attached by a suitable connector to a utilization device (not shown) to be moved with precision in response to the force applied to rod 5 by pneumatic piston 4.

The right-hand portion of rod 5 extends into a volume 22A of a hydraulic cylinder 20. Hydraulic cylinder 20 is rigidly attached to the right end wall 19 of pneumatic cylinder 2. Hydraulic piston 21 is bounded on its right-hand side by volume 22B of hydraulic cylinder 20. Both volumes 22A and 22B are entirely filled with oil or other suitable fluid.

Pneumatic cylinder 2 is actuated by high pressure air supplied to volume 3A of pneumatic cylinder 2 through an opening 9 and a conduit 10 if it is desired to force piston 4 from left to right. If it is desired to force pneumatic piston 4 from right to left, high pressure air is supplied via a passage in the housing of pneumatic cylinder 2 and conduit 17. Three-way valves 11 and 18 apply high pressure air from conduit 13 into a selected one of volumes 3A and 3B in response to control signals on conductors 14A and 14B. Valves 11 and 18 cause the conduits 10 and 17 to be coupled in communication with either vent outlets such as 12 or the high pressure air inlet 13 in response to signals 14A and 14B produced by electronic control system 15.

Pressure sensors 75 and 77 are embedded in the walls of volumes 3A and 3B, respectively. Conductors 76 and 78 connect pressure sensors 75 and 77, respectively to electronic control system 15, as shown in FIG. 1, to enable electronic control system 15 to determine the pressure differential across pneumatic piston 4 and hence the force produced thereby on rod 5.

Precisely controlled "bleeding" of oil from volume 22A to volume 22B, or vice versa, in hydraulic cylinder 20 is accomplished by means of a pair of digitally controlled valves 24 and 31. Digitally controlled valve 24 has one port connected by conduit 23 and passage 22 to volume 22B, and also has a second port connected by conduit 25 and passage 26 in the right-hand wall of pneumatic cylinder 2 to volume 22A. Precise control pulses applied to a pair of conductors collectively designated by reference numeral 27 control the durations in which valve 24 is open. Similarly, digitally controlled valve 31 communicates via conduit 30 and passage 28 with volume 22B, and also communicates via conduit 32 and passage 33 with volume 22A.

Ordinary leakproof seals are utilized between hydraulic piston 21 and the inner walls of hydraulic cylinder 20, so that when valves 24 and 31 are both closed, no appreciable movement of hydraulic piston 21 occurs, even when axial forces as large as 500 pounds are applied in either direction to rod 5 by pneumatic cylinder 4. The digitally controlled valves 24 and 31 may have different sized apertures. Each allows a different increment of controlled movement of hydraulic piston 21 in response to a control pulse on conductors 27 or 34 conductors for a predetermined force on rod 5. One of digitally controlled valves 24 and 31 is used to provide a "gross" position adjustment, while the other is used to provide a "fine" position adjustment.

If desired, a feedback control system can be used to provide an input to electronic control system 15 via conductor 39. This may be desirable in case one of the O-ring piston seals of hydraulic piston 21 fails. Conductor 39 reads the output produced from a photosensor 38, which receives a reflected beam 41 from a portion of rod 5 having thereon a sequence of alternately light and dark precisely spaced bars, each typically 1 mil wide. A suitable light source 37 energized by conductor 39A produces a beam 40 that is reflected from the lightly colored bars, but not the dark bars 36 on rod 5. By measuring the photosensor output signals produced on conductor 39 by photosensor 38, control system 15 can precisely determine the position of rod 5.

FIGS. 2A–2C illustrate the structure and operation of of the digitally controlled valves 24 and 31. Referring to FIG. 2A, digitally controlled valve 24 includes a cylinder 50 within which a piston 51 can move vertically. A fluid passage 52 extends entirely through the middle of piston 51. A pair of ports 23 and 25 in the wall of cylinder 50 are positioned so that they are precisely aligned with passage 52 when piston 51 is midway between its extreme upper and lower positions. Highly pressurized oil in volume 22A then is applied via conduit 25 to one port of digitally controlled valve 24, as indicated by arrow 58 of FIG. 2A. Initially, passage 52 is not aligned with the port 25. Leakproof seals are provided in the construction of valve 24 so that no oil bleeds from volume 22A to 22B of pneumatic cylinder 20.

In accordance with the present invention, the position of piston 51 is controlled by two solenoids 55 and 56, each of which communicate with rods 53 and 54 connected to the upper and lower sides of piston 51, respectively. Normally, one or the other of solenoids 55 and 56 will be actuated momentarily to produce an increment of movement of hydraulic piston 21.

For example, if the pulse P1 is applied between a pair of conductors 21A of solenoid 55, rod 53 will force piston 51 to accelerate from its upper "resting" position shown in FIG. 2A in the direction of arrow 57 toward its lower position. Piston 51 then accelerates so that passage 52 is momentarily aligned with ports 23 and 25. During this aligned condition, a predetermined amount of oil "bleeds" from volume 22A to 22B of pneumatic cylinder 20 as indicated by arrow 58 in FIG. 2B.

Piston 52 continues its movement passed the aligned configuration to its lower "resting" position shown in FIG. 2C; further bleeding of oil from volume 22A to volume 22B again is blocked, as indicated by arrow 58C. To produce another incremental movement of pneumatic piston 21, a pulse P2 is applied to conductors 27B of solenoid 56 to accelerate piston 51 upward at the same rate, resulting in another incremented movement of hydraulic piston 21.

Figure 6:
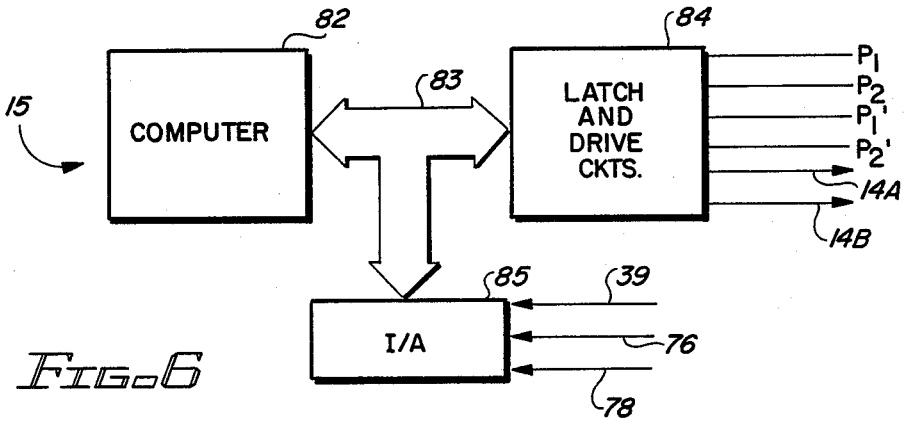
FIG. 6 is a block diagram of an electronic control system for the air-over-hydraulic actuator of the present invention.

FIG. 6 illustrates a block diagram of an electronic control system capable of producing the controlled pulses P1 and P2 needed to accomplish a predetermined amount of movement of rod 5 in accordance with the present invention. Control system 15 includes a computer 82, which can be any of a variety of commercially available microcomputing systems including a microprocessor, a random access memory, and a read only memory storing look-up tables of the characteristics of actuator system 1 as a function of air pressure in regions 3A and 3B and the widths of the pulses applied to digital valves 24 and 31.

Computer 82 is connected by means of a bus 83 to a plurality of latch and driver circuits 84 which receive control signals produced by computer 82 and generate the pulse signals P1, P2, P1', P2', and the pneumatic control signals 14A and 14B. Bus 83 also is connected to an interface/adaptor circuit 85 that receives the output signals 39 from the optical sensor 38 and also receives the output signals produced on conductors 76 and 78 by pressure sensors 75 and 77, respectively.

A wide variety of microcomputer systems have been implemented by those skilled in the art to perform control functions that are quite similar to those required for actuator system 1. Those skilled in the art can readily provide such microcomputer systems or purchase commercially available ones and provide the necessary operating programs therefor. As those skilled in the art know, a microcomputer operating system ordinarily performs an initializing function, setting initial values in all output latch circuits. In the present case, suitable initial states would be provided for pneumatic valves 11 and 18 and initial rest positions would be provided for the pistons of digital valves 24 and 31. If the optical feedback system is used, initial values would be provided for a counter circuit or a software counter that keeps track of the number of pulses produced on conductor 39. If it is desired to move piston rod 5 in a particular direction, and suitable initial air pressures have been provided in regions 3A and 3B to provide the desired force on rod 5 by pneumatic piston 4, the computer then receives the pressure signals 76 and 78, computes the pressure difference applied across piston 4, and computes the force applied to hydraulic piston 21 by rod 5. The computer then uses this information to address an empirically derived look-up table that stores information representing the width required for pulses P1 and P2 in order to allow 1 mil incremental movements of hydraulic piston 21 for the force presently applied thereto. The computer then outputs the necessary pulses to the solenoids of digital valve 24 as needed to allow piston 5 to advance incrementally the desired position. If the optical feedback system is used, the number of pulses on conductor 39 are counted, and if there is a discrepancy between the actual measured position of rod 5 with the position produced by applying a predetermined number of pulses to digital valves 24 and 31, an appropriate action can be taken. For example, one of the O-ring seals of hydraulic piston 21 might fail, leading to a discrepancy between the measured position of the rod and the desired position determined by counting the number of digital pulses applied to digital valves 24 and 31 and multiplying these counts by the incremental distance travelled by hydraulic piston 21 during each such digital pulse.

As mentioned above, in some instances it is desirable to provide a closed loop pressurizing and venting system for pneumatic cylinder 2. FIG. 3 shows a closed loop system, in which vent outlets 12 of pneumatic control valves 11 and 18 both feed into a low pressure air tank 61. Low pressure air tank 61 communicates by a conduit 64 to the inlet of an electrically powered pump 62, the outlet of which communicates with a high pressure tank 60. A control signal 65 is applied to pump 62 by electronic control system 15. The high pressure inlets of pneumatic valves 11 and 18 are coupled by tube 13 to the outlet of high pressure air tank 60.

Although the digital valves 24 and 31 are shown connected externally to hydraulic cylinder 20 in FIG. 1, it is possible to build the two digital valves 24 and 31 into the wall of pneumatic cylinder 20. In FIG. 1, dotted line 97 designates an exaggerated extension of the thickness of the wall of hydraulic cylinder 20, wherein tubes 23 and 25 and digital valve 24 are formed within the wall of hydraulic cylinder 20.

FIG. 4 illustrates another embodiment of the invention, wherein the digital valves 24 and 31 are formed within the hydraulic piston 21. Piston 51 of digital valve 24 is misaligned with ports 23 and 25, which are formed in hydraulic piston 21 and communicate with regions 22B and 22A, respectively, of hydraulic cylinder 20. The conductors 27A and 27B conducting digital pulses P1 and P2 extend through rod 7 and hydraulic piston 21 to solenoids 55 and 56, respectively, of digital valve 24.

Similarly, digital valve 31 also is formed in hydraulic piston 21, providing fluid communication between regions 22A and 22B when the piston of digital valve 31 is aligned with ports 30 and 32. Again, pulses P1 and P2 are coupled by conductors 87A and 87B, respectively, which are connected to the corresponding solenoids of digital valve 31.

The embodiment of the invention shown in FIG. 4 is capable of higher speed operation than embodiments in which the fluid passages coupling the left and right portions 22A and 22B of hydraulic cylinder extend from one end of hydraulic piston to the other, as shown in FIG. 1. This is because a much smaller mass of fluid is stored in the shorter passages or ports 23 and 25 in the structure of FIG. 4 than in the structure of FIG. 1. Consequently, less time is required for the fluid in the path 23, 52, 25, to be accelerated and decelerated during the actuating pulses P1, P2, etc. Those skilled in the art will recognize that the fluid through the ports 23 and 25 must be accelerated and decelerated by an amount that is greater than the acceleration and deceleration of hydraulic piston 21 by a factor equal to the ratio of the area of piston 21 to the area of ports 23 and 25.

FIG. 5 discloses a modified embodiment of the invention wherein a plurality of explosive charges, either solid or liquid, are implanted within volumes 3A and 3B of pneumatic cylinder 2. Suitable conductors 71 connected to electronic control system 15 are connected, respectively, to various ones of the charges 69 that are implanted in volume 3A. Similarly, conductors 72 connected to electronic control system 15 are connected, respectively, to various ones of the explosive charges 70 that are implanted in volume 3B.

In order to cause hydraulic piston 4 to apply a large force in the direction of arrows 73, one of the explosive charges 69 is detonated. Then the system is operated as described above with reference to FIG. 1 to provide controlled movement of rod 4 by applying precisely controlled pulses 27 and 34 to the digital control valves 24 and 31, respectively. If the direction of movement of rod 5 needs to be reversed, volume 3A is vented via valve 11 by the electronic control system 15; a selected one of the explosive charges 70 in volume 3B is detonated, and the hydraulic cylinder 20 and its digitally controlled valves 24 and 31 are actuated to provide precisely controlled movement of rod 5 in the direction of arrow 74.

In another embodiment of the invention, reference numerals 69 represent an ignitor, such as a spark plug and reference numeral 70 also designates such an ignitor. Explosive charges are injected into one or both of the volumes 3A by means of the valves 11 and/or 18. An appropriate one of the ignitors 69 or 70 is fired, causing a buildup of pressure in one of the volumes 3A and 3B. Creation of a suitable pressure differential across the pneumatic piston 4 can be accomplished by controlled venting via one of the valves 11 and 18, if desired. Precise movement of driven member 5 is controlled by applying controlled pulses to the digitally controlled valves 24 and 31, as previously described.

In yet another embodiment of the invention, no explosive charge is utilized in pneumatic cylinder 2. Instead, both volumes 3A and 3B are initially highly pressurized. Movement of the pneumatic piston 3 in either direction then is accomplished by controlled venting of either volume 3A or 3B by means of valves 11 and 18. A number of cycles of pneumatic piston 4 to the right and to the left can be achieved in this fashion, depending on how large a pressure differential is needed to cross piston 4 in order to produce the desired force on rod 4.

Figure 7:
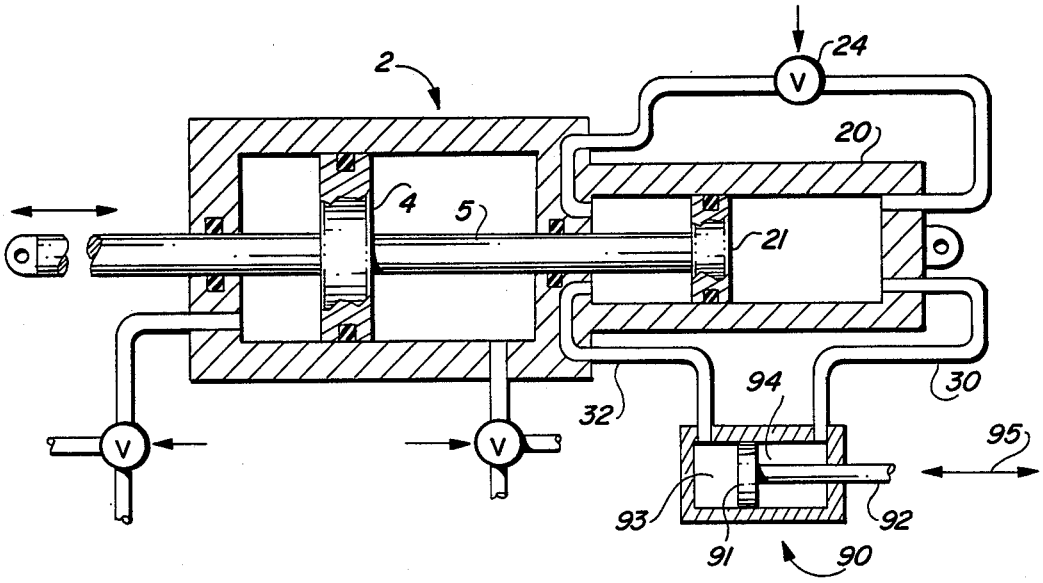
FIG. 7 is a section view diagram illustrating an embodiment of the invention for producing "forced adjustment" of the driven member of the air-over-hydraulic actuator of the present invention.

FIG. 7 shows another embodiment of the invention in which an auxiliary hydraulic cylinder 90 is provided in parallel communication with hydraulic piston 20, by means of fluid passages 30 and 32, connected as shown Auxiliary "forced adjustment" cylinder 90 includes a piston 91, the diameter of which is much smaller than the diameter of hydraulic piston 21. A relatively small adjustment force in either of the directions of arrows 95 can be applied to rod 92 to force hydraulic piston 91 to move by a small amount, thereby forcing hydraulic piston 21 and rod 5 to move through a distance equal to the distance through which piston 91 multiplied by the ratio between the cross-sectional areas of pistons 91 and 21. This occurs because the left-hand portion 22A of cylinder 20 is in fluid communication with the left-hand portion 93 of cylinder 90, while the right-hand portion 22B of cylinder 20 is in fluid communication with right-hand portion 94 of cylinder 20. This embodiment of the invention might be useful in a situation in which a predetermined number of digital pulses are utilized to move rod 5 to a certain position and it then is found desirable to make a further precise adjustment to the position of rod 5. The amount of force required to be applied to rod 92 in order to achieve this "forced adjustment" is equal to the force applied by pneumatic piston 4 to rod 5 multiplied by the ratio of the area of piston 91 to the area of hydraulic piston 21.

Figure 8:
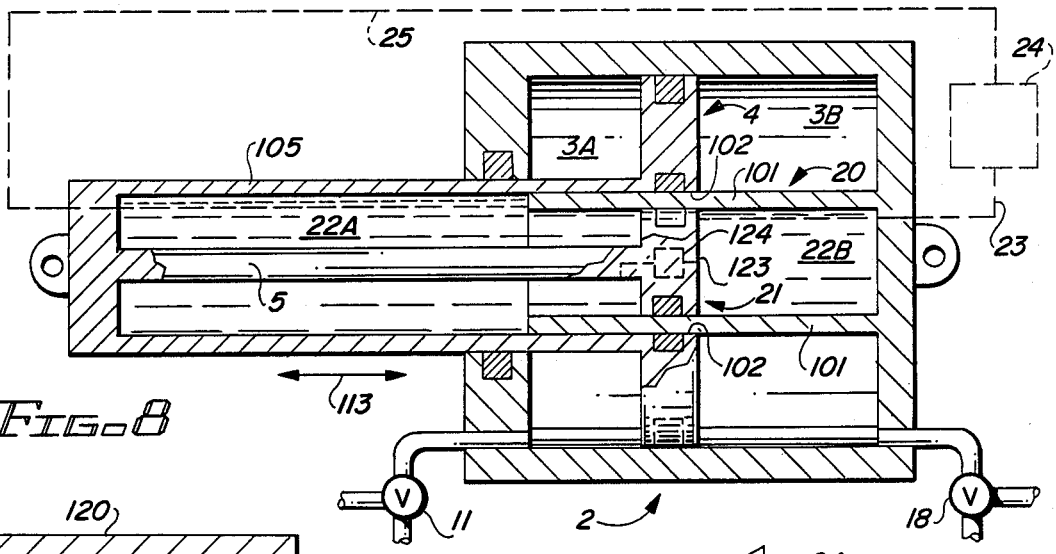
FIG. 8 is a section view diagram illustrating air-over-hydraulic actuator system wherein the hydraulic cylinder is contained within the pneumatic cylinder.

FIG. 8 shows an alternate embodiment of an air-over-hydraulic actuator that is quite similar to the one of FIG. 1, except that the hydraulic cylinder 20 is formed within pneumatic cylinder 2. Reference numeral 101 designates a hollow cylindrical wall of hydraulic cylinder 20, having an outer surface that precisely matches an aperture 102 through pneumatic piston 4.

Opening 102 in pneumatic piston 4 is continuous with a cylindrical bore through driven member 105. Driven member 105 is connected to the right-hand face of pneumatic piston 4, and extends slidably through a sealed opening in the left-hand end of pneumatic cylinder 2. The right-hand end of driven member 105 is closed. Reference numeral 5 designates the driven member connected to hydraulic piston 21. The left-end of driven member 5 is rigidly connected to the closed end of driven member 105.

It can be seen that as pneumatic piston 4 moves to the right or left, driven member 105 and driven member 5 both move simultaneously to the right or left as indicated by arrows 113 in FIG. 8. Oil or hydraulic fluid in volumes 22A and 22B of the hydraulic cylinder formed by the interior of cylindrical wall 101 and the cylindrical of driven member 105 is allowed to flow from one of volumes 22A and 22B to the other by pulsed digital valves, as previously described. In FIG. 8, reference numeral 124 designates a pulsed digital valve such as the ones shown in FIG. 4, formed within hydraulic piston 21. Dotted lines 123 designate the channel coupling volumes 22A and 22B to the digital valve 124. Alternately, dotted lines 24 in FIG. 8 designate an external pulsed digital valve similar to the one shown in FIGS. 2A–2C coupled by fluid paths 23 and 24 to volumes 22A and 22B of the hydraulic cylinder 20 This embodiment of the invention is more compact than the one shown in FIG. 1.

Figure 9:
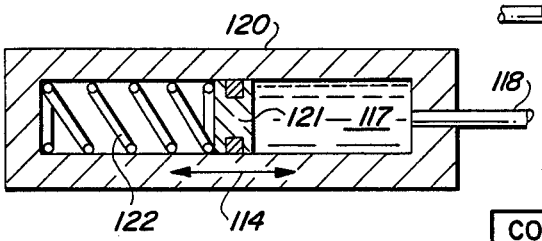
FIG. 9 is a section view diagram of a spring-biased oil reservoir that can be utilized in conjunction with the hydraulic cylinders of various described embodiments of the invention.

In FIG. 9, a spring-biased oil reservoir 120 is provided, having a movable piston 121 therein which is urged to the right by a bias spring 122. The right-hand compartment 117 of reservoir 120 is coupled via a fluid tube 118 to either volume 22A or 22B of a pulsed digital valve. Reservoir 120 could be used if it were not practical to provide a return fluid path from one side of the hydraulic cylinder to the other. Then, a reservoir such as 120 could be provided to receive oil from one side of the hydraulic piston, and then inject oil back in that side of the hydraulic piston when the hydraulic piston moves the opposite way.

Figure 10:
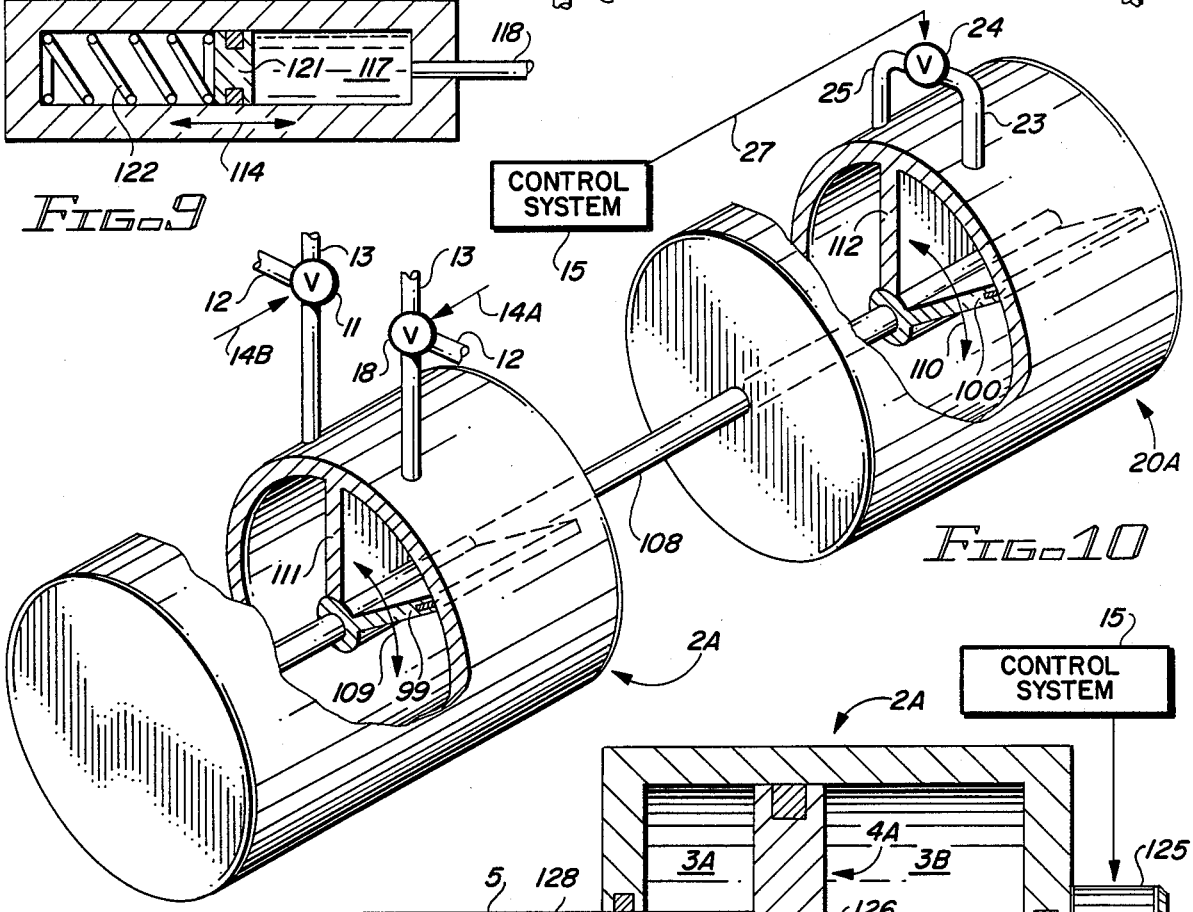
FIG. 10 is a partial cutaway perspective view illustrating an air-over-hydraulic actuator for producing precisely controlled angular movement, rather than linear movement, of a driven member.

FIG. 10 discloses a rotary version of the air-over-hydraulic actuator of FIG. 1. Reference numeral 2A designates a rotary cylinder in which a rigid stop or baffle 111 extends from the inner wall of the cylinder to the hub of a rotary vane piston 99 that is supported on a rotary driven member or axle 108. Pneumatic pressure is applied to either side of baffle or stop plate 111 by means of valves 11 and 18, in precisely the manner described with reference to FIG. 1. This produces a pressure differential across rotary vane piston 99, causing it to rotate in one of the directions indicated by arrows 109, causing an angular force on rotary driven member 108. Reference numeral 20A designates a similar cylinder containing oil on either side of a second rotary vane piston 100 that is attached to rotary driven member 108. A fixed vane or baffle plate 112 is provided in hydraulic cylinder 20A, and a pulsed digital valve 24 essentially identical to the one described previously with reference to FIG. 1 and FIGS. 2A–2C allows precisely controlled leakage through tubes 23 and 25 from one side of baffle 112 to the other, thus allowing precisely controlled rotary movement of rotary vane piston 100 and shaft 108 in response to control pulses supplied on conductor 27 to pulsed digital valve 24 by control system 50.

Figure 11:
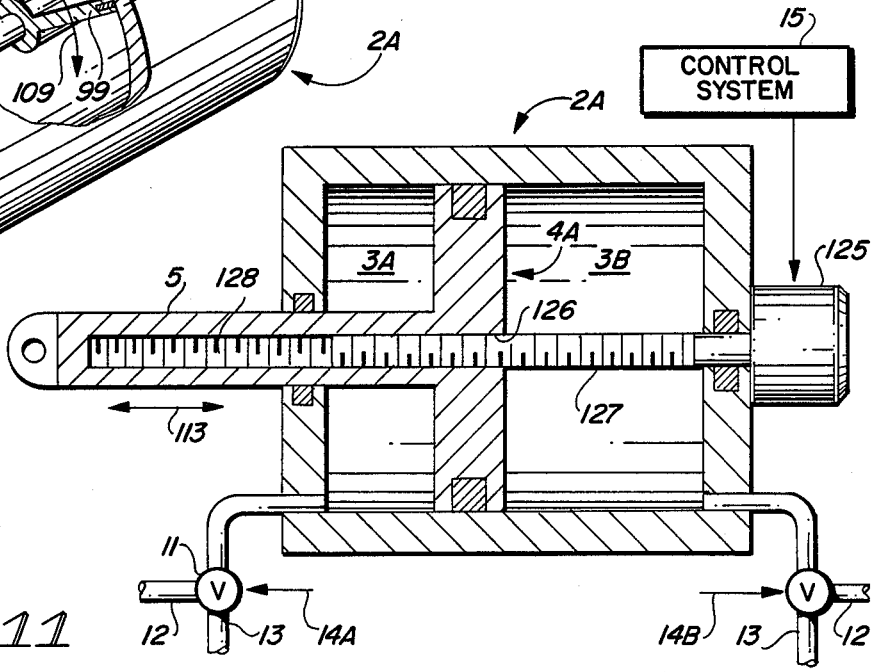
FIG. 11 is a section view diagram of an air-over-electric precision actuator in accordance with the present invention.

FIG. 11 shows a different type of actuator, in which the pneumatic cylinder 2B contains a pneumatic piston 4A. A differential pneumatic pressure is applied across pneumatic piston 4A by controlling pressure applied to or vented from the regions 3A and/or 3B in response to control system 15 in precisely the fashion previously described. However, movement of driven member 5 and piston 4A is not controlled by a hydraulic cylinder, as in the other described embodiments of the invention, but is instead controlled by a threaded hole 128 that extends through driven member 5 and piston 4A. A threaded jackscrew 127 is threaded into threaded hole 128. The right-hand of jackscrew 127 passes through a seal bearing in the right-hand wall of pneumatic cylinder 2A and is connected to a stepper motor 125. Depending on the pitch of the threads of jack screw 127 and threaded hole 128, a great mechanical advantage can be provided which allows a very small stepper motor 125 to be utilized to precisely control the movement of driven member 5 produced by a large force produced on pneumatic cylinder 4A. In this manner, a very large force, such as 500 pounds, produced on driven member 5 by pneumatic piston 4A can be extremely precisely controlled by a very small stepper motor 125, wherein each pulse applied by control system 15 to stepper motor 125 produces an extremely precise increment of movement of driven member 5 in the direction of the force being applied to driven member 5 by pneumatic piston 4A.

An advantage of all of the described embodiments of the invention is that the driven member maintains its position regardless of the force applied by the pneumatic piston to the driven member, even if all power to the system is lost, as long as there is no leak in the hydraulic system. Similarly, in the air-over-electric system of FIG. 11, if power is lost, the mechanical advantage of the jackscrew 27 with respect to the driven member 5 is sufficient that the position of the driven member remains unchanged if power is lost. While the invention has been described with reference to a particular embodiment thereof, those skilled in the art will be able to make various modifications to the described embodiment of the invention without departing from the true spirit and scope thereof. It is intended that all variations of the invention in which produce substantially the same function in substantially the same way to accomplish substantially the same result as the described embodiments of the invention are to be considered equivalent to the described embodiments of the invention. For example, the digital valve can be pneumatically or hydraulically actuated, instead of by solenoids. If desired, suitable diaphragms or bladders can be provided in the regions 3A and 3B of the pneumatic cylinder to prevent leakage from one side of the piston to the other.

I claim:

1. A method of operating a pneumatic-over-hydraulic system comprising the steps of:

(a) providing a pneumatic cylinder with a pneumatic piston therein, a hydraulic cylinder with a hydraulic piston therein, and means for connecting the pneumatic piston to the hydraulic piston so that movement of the pneymatic piston forces the hydraulic piston to move;

(b) providing a first digital fluid valve including first and second fluid ports coupled in fluid communication with opposite end portions of the hydraulic cylinder, and a first means for rapidly opening the first digital fluid valve and after a predetermined duration rapidly closing the first digital fluid valve in response to a control signal of the predetermined duration;

(c) applying a predetermined pressure difference across the pneumatic piston to produce a first predetermined force on the connecting means and thereby produce a second predetermined force on the hydraulic piston; and (d) successively applying a predetermined number of the control signals to the first means to open and close the first digital fluid valve the predetermined number of times to thereby allow the hydraulic piston and the connecting means to move through a predetermined distance.

2. The method of claim 1 including determining the duration of each of the control signals in accordance with the presence difference across the pneumatic piston.

3. The method of claim 2 including the step of sensing the pressure differential across the pneumatic piston and determining the duration of each of the control signals applied to the first means in response to the sensed pressure differential.

4. The method of claim 1 wherein the first means includes a movable member having a first fluid passage alignable with the first and second fluid ports and solenoid means responsive to the control signals for accelerating the movable member, the control signals being electrical signals, wherein odd numbered electrical signals accelerate the movable member from a first rest position to a second rest position and even numbered electrical signals accelerate the movable member from the second rest position to the first rest position.

5. The method of claim 4 wherein the duration of each electrical signal is such that each electrical signal accelerates the first fluid passage into and out of alignment with the first and second fluid ports sufficiently rapidly to allow bleeding of fluid from one side of the hydraulic piston to the other to cause the hydraulic piston to move precisely a predetermined incremental distance.

6. The method of claim 5 wherein the predetermined incremental distance is approximately 1 mil or less, and wherein the first predetermined force and the second predetermined force are greater than approximately 100 pounds.

7. The method of claim 1 including providing a second digital fluid valve substantially similar to the first, but allowing larger incremental movements of the hydraulic piston in response to each of a plurality of predetermined electrical signals applied to the second digital fluid valve.

8. The method of claim 1 including producing the pressure differential across the hydraulic piston by initially producing predetermined amounts of pressure in the pneumatic cylinder on each side of the pneumatic piston, and then producing precisely controlled venting of pressure on one side of the pneumatic piston to produce the predetermined pressure difference.

9. The method of claim 8 including producing the pressure differential by detonating at least one explosive charge within the pneumatic cylinder.

10. The method of claim 9 including producing the predetermined pressure difference by precisely controlling venting of pressure from one side of the pneumatic cylinder.

11. The method of claim 8 including determining the pressure differential and using that pressure differential to precisely determine the amount of venting pressure on one side of the pneumatic cylinder.

12. The method of claim 1 including conducting vented gas from the pneumatic system into a low pressure tank, pumping gas from the low pressure tank into a high pressure storage means, and supplying high pressure gas to the pneumatic cylinder.

13. The method of claim 1 including providing an auxiliary hydraulic cylinder in parallel fluid communication with the hydraulic cylinder, the auxiliary hydraulic cylinder having a piston that is much smaller in cross-sectional area than the hydraulic cylinder, and forcing the piston of the auxiliary to move a predetermined adjustment distance to precisely force the hydraulic piston and the connecting means to move a predetermined precise adjustment distance.

14. An actuator comprising in combination:

(a) a pneumatic cylinder with a penumatic piston thereon;

(b) a hydraulic cylinder with a hydraulic piston therein;

(c) means for connecting the pneumatic piston to the hydraulic piston so that movement of the pneumatic piston forces the hydraulic piston to move;

(d) a first digital fluid valve including first and second fluid ports coupled in fluid communication with opposite end portions of the hydraulic cylinder, and first means for rapidly opening the first digital fluid valve and after a predetermined duration rapidly closing the first digital fluid valve in response to a control signal of the predetermined duration;

(e) means for applying a predetermined pressure difference across the pneumatic piston to produce a first predetermined force on the connecting means and thereby produce a second predetermined force on the hydraulic piston; and (f) means for successively applying a predetermined number of the control signals in rapid succession to the first means to open and close the first fluid valve the predetermined number of times to thereby allow the hydraulic piston and the connecting means to move through a predetermined distance.

15. The actuator of claim 14 including means for determining the duration of each of the control signals in accordance with the pressure difference across the pneumatic piston.

16. The actuator of claim 15 including means for sensing the pressure differential across the pneumatic piston, the duration determination means determining the duration of each of the control signals applied to the first solenoid in response to the sensed pressure differential.

17. The actuator of claim 14 wherein the first means includes a movable member having a first fluid passage alignable with the first and second fluid ports and a first solenoid connected to the movable member to move the first fluid passage in a first direction past the first and second fluid ports and wherein the first digital fluid valve includes a second solenoid connected to the movable member to move the first fluid passage in a second direction past the first and second fluid ports in response to another electrical signal of the predetermined duration, wherein odd numbered electrical signals accelerate the movable member of the digital valve from a first rest position to a second rest position and even numbered electrical signals accelerate the movable member from the second rest position to the first rest position.

18. The actuator of claim 17 wherein the duration of each electrical pulse is such that each electrical pulse accelerates the first fluid passage into and out of alignment with the first and second fluid ports sufficiently rapidly to allow bleeding of fluid from one side of the hydraulic piston to the other to cause the hydraulic piston to move precisely a predetermined incremental distance.

19. The actuator of claim 18 wherein the predetermined incremental distance is approximately 1 mil.

20. The actuator of claim 17 wherein the first digital valve and the first and second fluid ports are located in the hydraulic piston, and the electrical pulse applying means includes a conductor passing through the connecting means to the first solenoid and the second solenoid.

21. The actuator of claim 14 including a second digital fluid valve substantially similar to the first, but allowing larger incremental movements of the hydraulic piston in response to each of a plurality of predetermined electrical signals.

22. The method of claim 14 including means for producing predetermined amounts of pressure in the pneumatic cylinder on each side of the pneumatic piston, and means for precisely venting controlled amounts of pressure on one side of the pneumatic piston to produce the predetermined pressure difference.

23. The actuator of claim 22 including means for providing at least one explosive charge in the pneumatic cylinder, and means for detonating at least one explosive charge within the pneumatic cylinder to produce a pressure differential across the pneumatic cylinder.

24. The actuator of claim 23 including means for precisely controlling venting of pressure from one side of the pneumatic cylinder to produce the predetermined pressure difference.

25. The actuator of claim 22 including means for determining the pressure differential and using that pressure differential to precisely determine the amount of venting pressure on one side of the pneumatic cylinder.

26. The actuator of claim 14 including a low pressure tank, means for conducting vented gas from the pneumatic system into the low pressure tank, and means for pumping gas from the low pressure tank into a high pressure storage means and into the pneumatic cylinder.

27. The actuator of claim 14 including an auxiliary hydraulic cylinder connected in parallel fluid communication with the hydraulic cylinder, the auxiliary hydraulic cylinder having a piston that is much smaller in cross-sectional area than the hydraulic cylinder, and means for forcing the piston of the auxiliary hydraulic cylinder to move a predetermined adjustment distance to precisely force the hydraulic piston and the connecting means to move through a predetermined precise adjustment distance.

28. An actuator comprising in combination:

(a) a first cylinder with a first piston thereon;

(b) a hydraulic cylinder with a hydrauic piston therein;

(c) means for connecting the first piston to the hydraulic piston so that movement of the first piston forces the hydraulic piston to move;

(d) a first digital fluid valve including first and second fluid ports coupled in fluid communication with opposite end portions of the hydraulic cylinder, and first means for rapidly opening the first digital fluid valve and after a predetermined duration rapidly closing the first digital fluid valve in response to a control signal of the predetermined duration;

(e) means for applying a predetermined pressure difference across the first piston to produce a first predetermined force on the connecting means and thereby produce a second predetermined force on the hydraulic piston; and (f) means for successively applying a predetermined number of the control signals in rapid succession to the first means to open and close the first fluid valve the predetermined number of times to thereby allow the hydraulic piston and the connecting means to move through a predetermined distance.

29. The actuator of claim 28 wherein the first piston is a rotary vane piston and the hydraulic piston is a hydraulic vane piston, and the connecting means rotates in response to rotation of the rotary vane piston, causing the hydraulic vane piston to rotate.

* * * * *